US006475604B1

(12) United States Patent
Fujii et al.

(10) Patent No.: US 6,475,604 B1
(45) Date of Patent: Nov. 5, 2002

(54) THIN FILM THERMISTOR ELEMENT AND METHOD FOR THE FABRICATION OF THIN FILM THERMISTOR ELEMENT

(75) Inventors: Eiji Fujii, Hirakata; Atsushi Tomozawa, Osaka; Hideo Torii, Higashiosaka; Ryoichi Takayama, Suita, all of (JP)

(73) Assignee: Matsushita Electric Industrial Co., Ltd. (JP)

( * ) Notice: Subject to any disclaimer, the term of this patent is extended or adjusted under 35 U.S.C. 154(b) by 107 days.

(21) Appl. No.: 09/584,768

(22) Filed: Jun. 1, 2000

(30) Foreign Application Priority Data

| | | |
|---|---|---|
| Jun. 3, 1999 | (JP) | 11-156569 |
| Jun. 3, 1999 | (JP) | 11-156626 |
| Jun. 3, 1999 | (JP) | 11-156708 |
| Jun. 9, 1999 | (JP) | 11-161903 |
| Sep. 9, 1999 | (JP) | 11-255225 |

(51) Int. Cl.[7] ..... H01C 7/00

(52) U.S. Cl. ..... 428/209; 428/469; 428/471; 428/697; 428/702; 338/22 R

(58) Field of Search ..... 428/209, 469, 428/471, 697, 699, 702; 338/22 R

(56) References Cited

U.S. PATENT DOCUMENTS

| | | | | |
|---|---|---|---|---|
| 4,013,592 A | * | 3/1977 | Matsuoka et al. | 252/521 |
| 4,952,902 A | * | 8/1990 | Kawaguchi et al. | 338/22 R |
| 5,273,776 A | | 12/1993 | Yonezawa et al. | 427/101 |
| 5,600,296 A | | 2/1997 | Kuzuoka et al. | 338/22 R |
| 6,099,164 A | * | 8/2000 | Rosen et al. | 374/185 |

FOREIGN PATENT DOCUMENTS

| | | | |
|---|---|---|---|
| EP | 0609776 A1 | * | 8/1994 |
| JP | 358016124 A | * | 1/1983 |
| JP | 63-266901 | | 11/1988 |
| JP | 3-054842 | | 8/1991 |
| JP | 407066007 A | * | 3/1995 |
| JP | 7-230902 | | 8/1995 |
| JP | 410294204 A | * | 11/1998 |
| JP | 411233304 A | * | 8/1999 |

OTHER PUBLICATIONS

Annealing Effects of Some Electrical Properties of Mn–Co–Fe Thin Film Thermistor by Yoichiro Masuda and Akira Baba (complete translation) No date.

* cited by examiner

*Primary Examiner*—Deborah Jones
*Assistant Examiner*—Stephen Stein
(74) *Attorney, Agent, or Firm*—Parkhurst & Wendel, L.L.P.

(57) ABSTRACT

A thin film thermistor element 10 is formed by forming on a backing substrate 11 of alumina a thermistor thin film 12 and a pair of comb electrodes 13 and 14 formed of a thin film of Pt. The thermistor thin film 12, which is formed of, for example, complex oxide of Mn—Co—Ni, has either a spinel type crystal structure which is priority oriented or oriented mainly in a (100) surface or a bixbite type crystal structure which is priority oriented in a (100) or (111) surface. Alternatively, the thermistor thin film is formed of $LaCoO_3$ and has a rhombohedral bixbite type crystal structure. This makes it possible to hold the variation in resistance value low thereby to achieve high accuracy, and the deterioration with time can be held low and the high temperature durability can be improved, for the achievement of high reliability.

9 Claims, 3 Drawing Sheets

THIN FILM THERMISTOR ELEMENT AND METHOD FOR THE FABRICATION OF THIN FILM THERMISTOR ELEMENT

BACKGROUND OF THE INVENTION (1) Field of the Invention

The present invention relates to a thin film thermistor element (a thin film NTC thermistor element) for use in temperature sensors of a variety of equipment such as information processing equipment, communication equipment, housing-facility equipment, automobile electrical equipment, and to a method for the fabrication thereof.

(2) Description of the Related Art

An NTC thermistor element of oxide semiconductor material as an element for the detection of temperature is typically constructed by formation of an electrode (e.g., an electrode of Ag) on an end face of an oxide sintered body chip whose major component is a transition metal such as Mn, Co, Ni, and Fe and which has a spinel type crystal structure, by means of application or baking.

Such NTC thermistor elements have the following advantages over thermocouples and platinum resistance temperature sensors. Therefore, the NTC thermistor element has currently been in wide use.

(1) The resistance temperature change is great, allowing high temperature resolution;

(2) Determination can be carried out with a simple circuit;

(3) Formed of material which is relatively stable and unsusceptible to the influence of ambient conditions, achieving less deterioration with time, being superior in reliability; and (4) Mass production is possible, holding down costs.

Further, the NTC thermistor element is used not only to measure the temperature of an object but also to control a current in a power supply device. The NTC thermistor element has the property that its resistance value is high at room temperature but decreases as the temperature rises. Because of such a property, the NTC thermistor element serves, for example, in a switching power supply, as an excessive current control element which controls an excessive current (i.e., an initial rush current) that starts flowing the instant the power supply switch is turned on and which thereafter becomes low in resistance with the rise of temperature by self exothermicity, whereby the loss of power is held low in the steady state. NTC thermistor elements that find their way into such an application are fabricated from, for example, rare earth transition metal oxide as a thermistor material. More specifically, a sintered body of lanthanum cobalt oxide having a perovskite type crystal structure is used, wherein a thin film electrode of silver is formed atop the sintered body by means of sputtering (see Japanese Unexamined Patent Gazette No. H07-230902).

Apart from the above, recently, with the reduction in size and weight of electronic equipment and with the improvement in performance of same, there have been strong demands for the ultra-miniaturization of thermistor elements in element size (for example, below 1 mm×0.5 mm) as well as for the high accurization of the resistance value and the B constant, i.e., the resistance change-rate with respect to temperature, at measuring temperatures (for example, a variation of 3% or below). However, due to some processing problems, difficulties will arise when considerably downsizing such a thermistor element comprising an oxide sintered body. In addition, there is created the disadvantage that, as thermistor elements are down-sized, both the resistance value and the B constant undergo greater variation because of the problem of processing accuracy.

In order to cope with such problems associated with thermistor elements using oxide whose major component is a transition metal, such as Mn, Co, Ni, and Fe, having a spinel type crystal structure, the development of thin film thermistor elements employing thin film technology for the formation of thermistor material and electrodes has now been popular. This type of thin film thermistor element is fabricated as follows. A thermistor thin film is formed by a sputtering technique targeting on a sintered body of complex oxide of, for example, Mn, Ni, Co, and Fe, which is followed by formation of a predefined electrode pattern on the thermistor thin film. However, such a thermistor thin film formed by sputtering suffers several problems. First, it is unlikely to obtain good crystallinity. Second, the stability is low, therefore resulting in causing both the resistance value and the B constant to undergo considerable variation with time. The particular problem is that high temperature durability is low. As to this problem, a technique has been known in the art, in which a thermistor thin film formed by sputtering is subjected to heat treatment in air at, for example, from 200 to 800 degrees centigrade for crystallization to have a spinel type structure (see Japanese Unexamined Patent Gazette No. S63-266801, Japanese Unexamined Patent Gazette No. H03–54842, and "Yashiro Institute of Technology Transactions" Vol. 8, pp. 25–34, by Masuda and others).

However, in the case such a thermistor thin film of spinel type oxide semiconductor formed by sputtering is crystal grown by heat treatment, it is likely that the variation in crystal grain diameter in the resulting polycrystalline substance is great. Because of this, even with regard to thermistor elements of the same fabrication lot, they vary considerably in electrical characteristic, e.g., the resistance value and the B constant. Moreover, even if heat treatment is carried out at, for example, 400 degrees centigrade or above, this will find difficulties in improving stability to a greater extent, and it is also difficult to improve high temperature durability.

SUMMARY OF THE INVENTION

Bearing in mind the above-described points, the present invention was made. Accordingly, an object of the present invention is to provide a thin film thermistor element capable of holding, for example, the variation in resistance value low for the achievement of high accuracy and capable of improving high temperature durability for the achievement of high reliability, and a method for the fabrication of such a thin film thermistor element.

In order to achieve the above-described object, the present invention provides a thin film thermistor element. The thin film thermistor element of the present invention comprises a thermistor thin film and a pair of electrodes formed on the thermistor thin film, wherein the thermistor thin film has either a spinel type crystal structure which is oriented mainly in a (100) surface, a bixbite type crystal structure (particularly, a bixbite type crystal structure which is oriented mainly in a (100) or (111) surface), or a rhombohedral perovskite type crystal structure (particularly, a rhombohedral perovskite type crystal structure which is oriented mainly in (012). A thermistor thin film having a spinel type crystal structure with a (100) surface orientation or bixbite type crystal structure can be formed of, for example, a thin film of oxide whose major component is manganese. Further, a thermistor thin film having a rhombohedral perovskite type crystal structure can be formed of, for example, a composition containing lanthanum cobalt oxide. Furthermore, it is preferred that a thermistor thin film having a spinel type crystal structure with a (100) surface orientation has a crystal grain which has grown by crystallization into a columnar shape in a direction perpendicular with respect to the thermistor thin film.

The above-described thermistor thin films of the present invention each show less variation in the crystal grain diameter in comparison with thermistors of a sintered body and thermistor thin films having a no-orientation spinel type crystal structure, because of which the variation in electrical characteristic (such as the resistance value and B constant (i.e., the change rate of resistance to temperature) can be held low and, in addition, the crystal state is relatively stable so that the deterioration with time of such electrical characteristics can be held low and the high temperature durability is high. Accordingly, with such a crystal structure, it becomes possible to achieve high-accuracy, high-reliability thermistor elements. Further, formation is carried out through the use of thin film technology, whereby downsizing is easier to achieve in comparison with the case where a sintered body thermistor is employed.

Thermistor thin films of the type described above can be formed by alternately carrying out a film formation step by, for example, sputtering and an anneal step. More specifically, an arrangement is made, wherein at least either one of a substrate holder for holding a backing substrate and a target placed face to face with the substrate holder is rotated and wherein the backing substrate is held at a position eccentric from the center of the rotation in the substrate holder while the target is covered with a shield cover so that a part of a position eccentric from the rotational center in the target is exposed, whereby the film formation step by sputtering can be carried out on the backing substrate at a rotational position whereat the backing substrate faces the exposed portion of the target while on the other hand the anneal step can be carried out at a rotational position whereat the backing substrate faces the position of the target covered with the shield cover. Further, it is possible to form a higher-accuracy, higher-reliability thermistor element by performing a heat treatment after the formation of a thermistor thin film of the type described above, wherein the substrate temperature and the heat treatment temperature during the film formation by sputtering are set to various values according to the composition and the film formation time of a thermistor thin film that is formed. For example, a film formation step is carried out with a substrate heated to 200–600 degrees centigrade and a heat treatment is carried out in air at 600–1000 degrees centigrade, whereby the foregoing thermistor clement can be fabricated easily. If the thermistor thin film formation is carried out in an atmosphere in which the rate of flow between argon gas and oxygen gas is 3 or greater, this relatively facilitates formation of a thermistor thin film having a spinel type crystal structure with a (100) surface orientation, and if the heat treatment is carried out at 1100 degrees centigrade or below, this relatively facilitates formation of a thermistor thin film having a bixbite type crystal structure.

Moreover, in the above-described thin film thermistor element, an electrode is provided with a trimming portion for the adjustment of resistance, and the trimming portion is cut using laser light irradiation or the like to make a resistance adjustment, whereby it becomes possible to facilitate the fabrication of higher-accuracy thin film thermistor elements.

DESCRIPTION OF THE PREFERRED EMBODIMENTS

Embodiment 1

Figure 1:
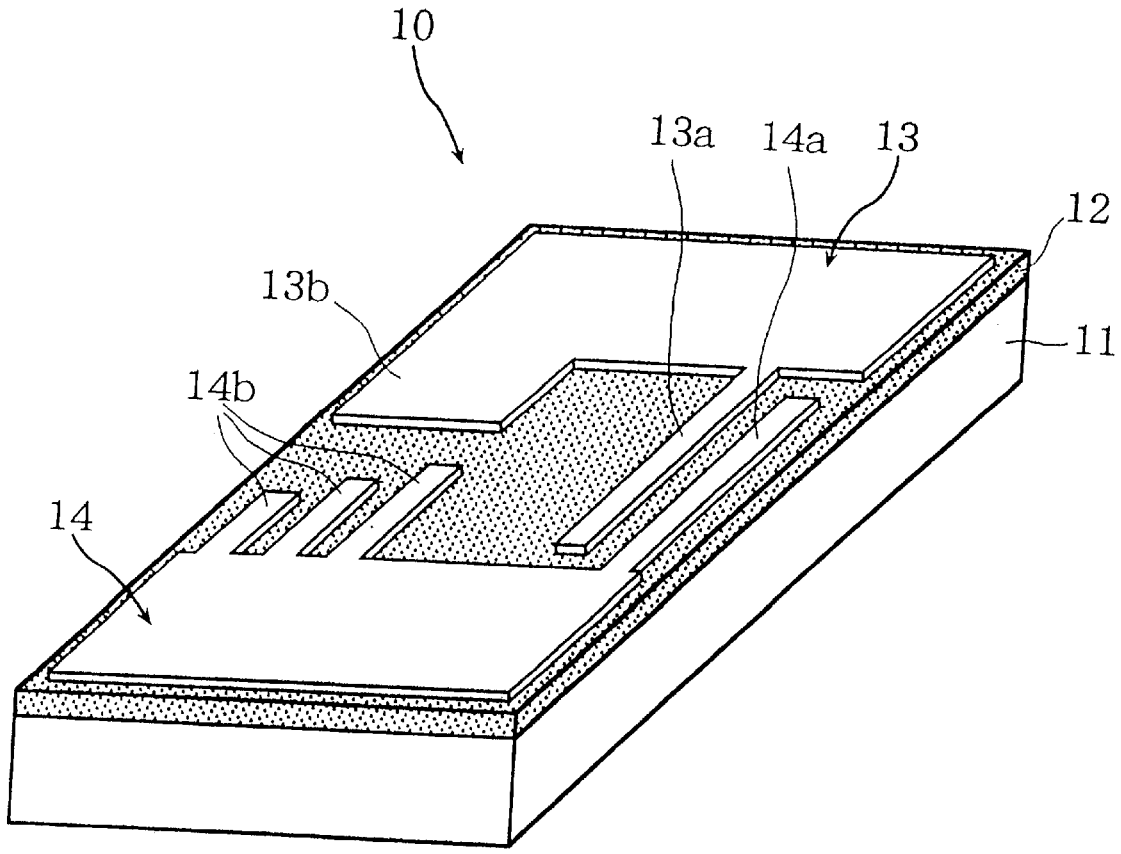
FIG. 1 is a perspective view illustrating a structure of a thin film thermistor element according to the present invention.

Referring first to FIG. 1, there is shown a thin film thermistor element 10 in which a thermistor thin film 12 and a pair of comb electrodes 13 and 14 comprising a thin film of Pt are formed on a backing substrate of alumina. The thermistor thin film 12 is composed of, for example, complex oxide of Mn—Co—Ni that has a spinel type crystal structure which is priority oriented in a (100) surface, in other words which is oriented mainly in a (100) surface. Moreover, the comb electrode 13 has a base resistance portion 13*a* and a trimming portion 13*b*, whereas the comb electrode 14 has a base resistance portion 14*a* and a trimming portion 14*b*. Each base resistance portion 13*a* and 14*a* is for setting the resistance of the thin film thermistor element 10 roughly to a target value. On the other hand, each trimming portion 13*b* and 14*b* is for making fine adjustment so as to obtain resistance values at predefined accuracy. Such resistance value fine adjustment will be discussed later in detail.

Figure 2:
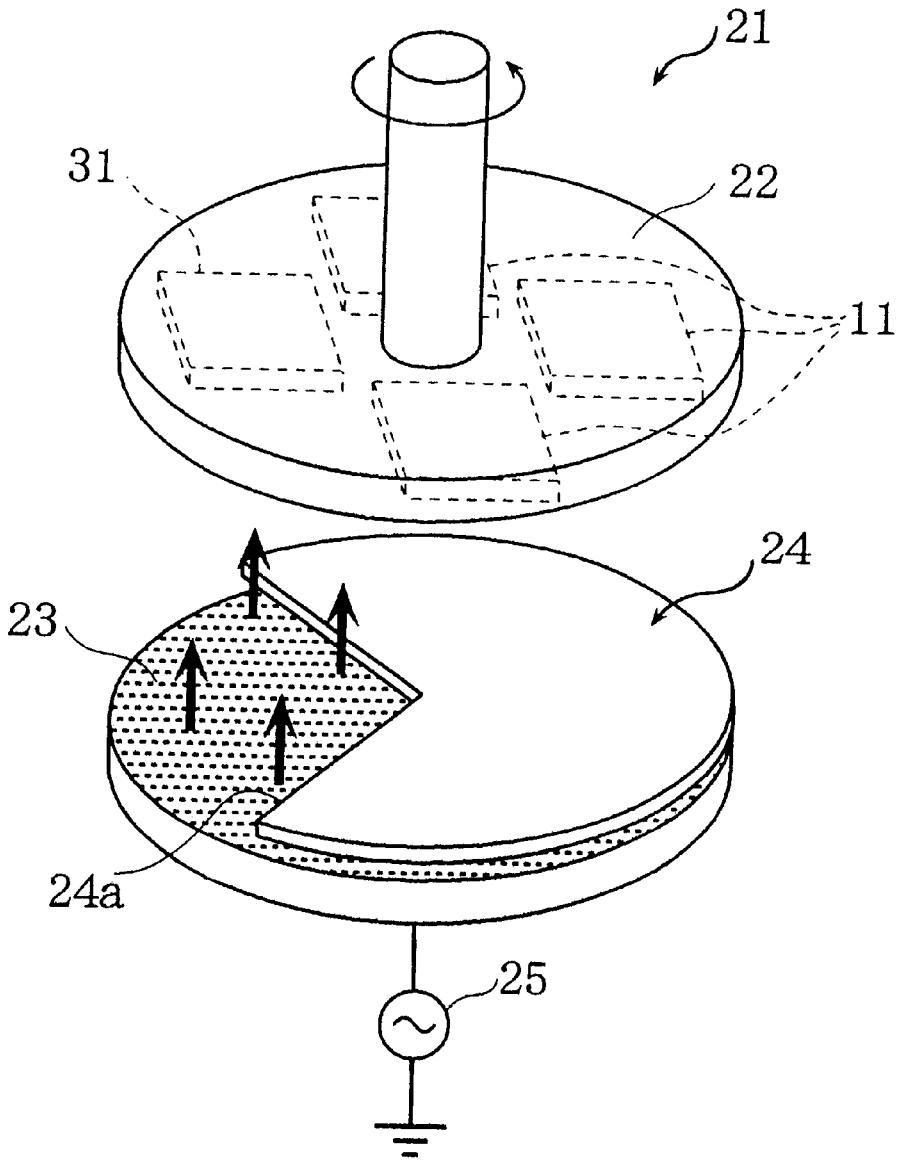
FIG. 2 is a perspective view illustrating a structure of a device used to fabricate a thin film thermistor element according to the present invention.

The thermistor thin film 12 of the foregoing type can be fabricated using, for example, a sputter device 21 as shown in FIG. 2. In the sputter device 21, a substrate holder 22 for supporting the backing substrate 11, and a sintered body target 23 of, for example, complex oxide formed of Mn—Co—Ni having a diameter of 8 inches are mounted face to face with each other at an interval of 50 mm. The sintered body target 23 is covered with a shield cover 24 having a notch 24 a whose central angle is 90 degrees in such a way that a part of the sintered body target 23 is exposed. Coupled to the sintered body target 23 is a high frequency power supply 25 (13.56 MHz). On the other hand, it is arranged such that the substrate holder 22 is rotated by a drive device (not shown in the figure) at a predefined rotational speed. Both the substrate holder 22 and the sintered body target 23 are placed in a chamber (not shown in the figure) filled with, for example, a mixed gas of argon and oxygen.

With the backing substrate 11 held by the substrate holder 22, heating is carried out, and the substrate holder 22 is rotated at a predefined rotational speed while at the same time a high frequency voltage is applied to the sintered body target 23. At the time when the backing substrate 11 passes over the notch 24 a of the shield cover 24, grains flying from the sintered body target 23 are sputtered to form the thermistor thin film 12. On the other hand, at the time when the backing substrate 11 passes over the shield cover 24, the thermistor thin film 12 is oxidized and annealed. In other words, sputtering, oxidation, and anneal are carried out alternately for the formation of the thermistor thin film 12. Further, in order to alternately perform sputtering and oxidation/anneal, the rotating of the substrate holder 22, as describe above, is one possible way and another possible way is to dispose a shield plate extendably and retractably between the substrate holder 22 and the sintered body target 23.

The thermistor thin film 12 thus formed is subjected to heat treatment at a predefined temperature. The resulting thermistor thin film 12 has a spinel type crystal structure which is oriented mainly in a (100) surface, being even in crystal grain diameter.

Formation Conditions and Characteristics

Hereinafter, the formation conditions of the thermistor thin film 12 (i.e., the condition of sputtering and the condition of heat treatment) will be described in a more concrete manner, together with the characteristics of the resulting thermistor thin film 12 and thin film thermistor element 10.

With regard to experimental examples A1–A8 and their corresponding compare examples A1–A8, thermistor thin films 12 were formed under conditions as shown in TABLE 1. Then, these thermistor thin films 12 thus formed were subjected to heat treatment in air under conditions as shown in the table. The major difference between EXPERIMENTAL EXAMPLE (A1–A8) and COMPARE EXAMPLE (A1-A8) is the presence or absence of rotation of the substrate holder 22. That is to say, in EXPERIMENTAL EXAMPLES A1–A8, as describe above, sputtering and oxidation/anneal are carried out alternately, while on the other hand in COMPARE EXAMPLES A1–A8 sputtering is carried out continuously without the provision of the shield cover 24. Here, alumina substrates, sized to have dimensions of 50 mm×50 mm×0.3 mm and polished to such an extent that their surface irregularity fell below 0.03 μm, were used; as the backing substrate 11. The substrate holder 22 was made to hold, in addition to the backing substrate 11, a glass substrate 31 for the purpose of evaluating crystallinity.

TABLE 1

| | Target Composition | Ar/O2 Flow Rate (SCCM) | Gas Pressure (Pa) | Substrate Temperature (° C.) | Plasma Power (W) | Holder Revolution (rpm) | Film Formation Time (Minute) | Film Thickness (μ) | Heat Treatment Temperature (° C.) | Heat Treatment Time (Hour) |
|---|---|---|---|---|---|---|---|---|---|---|
| EXPERIMENTAL EXAMPLE A1 | Mn—Co—Ni | 19.5/0.5 | 1 | 400 | 900 | 5 | 120 | 1 | 750 | 20 |
| COMPARE EXAMPLE A1 | Mn—Co—Ni | 8/2 | 1 | 400 | 400 | — | 90 | 1 | 750 | 20 |
| EXPERIMENTAL EXAMPLE A2 | Mn—Co—Ni—Fe | 20/0 | 1 | 300 | 800 | 8 | 130 | 1 | 900 | 10 |
| COMPARE EXAMPLE A2 | Mn—Co—Ni—Fe | 10/1 | 1 | 300 | 400 | — | 80 | 0.9 | 900 | 10 |
| EXPERIMENTAL EXAMPLE A3 | Mn—Co—Ni—Al | 15/5 | 0.5 | 400 | 800 | 5 | 130 | 1.2 | 700 | 10 |
| COMPARE EXAMPLE A3 | Mn—Co—Ni—Al | 17/3 | 0.5 | 400 | 600 | — | 70 | 1 | 700 | 10 |
| EXPERIMENTAL EXAMPLE A4 | Mn—Co—Ni—Cr | 19/1 | 1 | 600 | 800 | 10 | 180 | 1.4 | 700 | 10 |
| COMPARE EXAMPLE A4 | Mn—Co—Ni—Cr | 6/1 | 1 | 600 | 500 | — | 90 | 1.3 | 700 | 10 |
| EXPERIMENTAL EXAMPLE A5 | Mn—Co—Cu | 19.5/0.5 | 1 | 200 | 1000 | 4 | 100 | 0.7 | 1000 | 10 |
| COMPARE EXAMPLE A5 | Mn—Co—Cu | 4/1 | 1 | 200 | 400 | — | 70 | 0.9 | 1000 | 10 |
| EXPERIMENTAL EXAMPLE A6 | Mn—CO | 20/0 | 1 | 500 | 900 | 10 | 140 | 1 | 600 | 30 |
| COMPARE EXAMPLE A6 | Mn—Co | 5/1 | 1 | 500 | 500 | — | 75 | 1.1 | 600 | 30 |
| EXPERIMENTAL EXAMPLE A7 | Mn—Ni | 19/1 | 1 | 400 | 1200 | 8 | 140 | 1.4 | 700 | 5 |
| COMPARE EXAMPLE A7 | Mn—Ni | 9/1 | 1 | 400 | 400 | — | 90 | 1.2 | 700 | 5 |
| EXPERIMENTAL EXAMPLE A8 | Mn—Co—Fe | 19/1 | 1 | 350 | 900 | 4 | 120 | 0.9 | 800 | 10 |
| COMPARE EXAMPLE A8 | Mn—Co—Fe | 10/1 | 1 | 350 | 400 | — | 80 | 1 | 800 | 10 |

The following were performed on the thermistor thin films 12 formed on the respective glass substrates 31 and then subjected to heat treatment in the way as described above.

(1) Composition analysis by X ray microanalyzer;

(2) Crystal-structure observation by X ray diffraction (XRD) analysis; and (3) Film surface/broken-out section observation by scanning electron microscope (SEM)

The results are shown in TABLE 2.

TABLE 2

| | Thermistor Thin Film Composition Ratio | Crystal Structure | Orientation | Crystal Shape | Grain Diameter (nm) | Average Value(*) Resistance Value/B Constant |
|---|---|---|---|---|---|---|
| EXPERIMENTAL EXAMPLE A1 | Mn:Co:Ni = 53:19:28 | Spinel Type | (100)Orientation | Columnar Structure | 100^200 | 279kΩ/3580K |
| COMPARATIVE EXAMPLE A1 | Mn:Co:Ni = 51:20:29 | Spinel Type | Random | | 50^350 | 272kΩ/3560K |
| EXPERIMENTAL EXAMPLE A2 | Mn:Co:Ni:Fe = 51:17:26:6 | Spinel Type | (100)Orientation | Columnar Structure | 150^250 | 318kΩ/3450K |
| COMPARATIVE EXAMPLE A2 | Mn:Co:Ni:Fe = 49:23:22:6 | Spinel Type | Random | | 50^350 | 343kΩ/3467K |
| EXPERIMENTAL EXAMPLE A3 | Mn:Co:Ni:Al = 52:17:26:5 | Spinel Type | (100)Orientation | Columnar Structure | 100^150 | 243kΩ/3490K |
| COMPARATIVE EXAMPLE A3 | Mn:Co:Ni:Al = 53:17:24:6 | Spinel Type | Random | | 50^300 | 273kΩ/3474K |
| EXPERIMENTAL EXAMPLE A4 | Mn:Co:Ni:Cr = 60:20:17:3 | Spinel Type | (100)Orientation | Columnar Structure | 100^250 | 267kΩ/3675K |
| COMPARATIVE EXAMPLE A4 | Mn:Co:Ni:Cr = 60:20:16:4 | Spinel Type | Random | | 50^300 | 279kΩ/3620K |
| EXPERIMENTAL EXAMPLE A5 | Mn:Co:Cu = 45:30:5 | Spinel Type | (100)Orientation | Columnar Structure | 200^350 | 32kΩ/2960K |
| COMPARATIVE EXAMPLE A5 | Mn:Co:Cu = 64:31:5 | Spinel Type | Random | | 50^400 | 38kΩ/2984K |
| EXPERIMENTAL EXAMPLE A6 | Mn:Co = 73:27 | Spinel Type | (100)Orientation | Columnar Structure | 100^250 | 210kΩ/3393K |
| COMPARATIVE EXAMPLE A6 | Mn:Co = 74:26 | Spinel Type | Random | | 50^300 | 207kΩ/3405K |
| EXPERIMENTAL EXAMPLE A7 | Mn:Ni = 55:45 | Spinel Type | (100)Orientation | Columnar | 100^200 | 251kΩ/3590K |
| COMPARATIVE EXAMPLE A7 | Mn:Ni = 58:42 | Spinel Type | Random | | 50^350 | 279kΩ/3575K |
| EXPERIMENTAL EXAMPLE A8 | Mn:Co:Fe = 54:31:15 | Spinel Type | (100)Orientation | Columnar Structure | 200^350 | 310kΩ/3660K |
| COMPARATIVE EXAMPLE A8 | Mn:Co:Fe = 53:29:18 | Spinel Type | Random | | 50^400 | 298kΩ/3684K |

| | Variation(*) Resistance Value/B Constant | High Temperature Durability Change(**) Resistance Value/B Constant |
|---|---|---|
| EXPERIMENTAL EXAMPLE A1 | 2%/0.4% | 2%/1% |
| COMPARATIVE EXAMPLE A1 | 4%/1.5% | 3%/2% |
| EXPERIMENTAL EXAMPLE A2 | 2%/0.5% | 3%/1% |
| COMPARATIVE EXAMPLE A2 | 4%/1.5% | 5%/2% |
| EXPERIMENTAL EXAMPLE A3 | 3%/0.3% | 2%/1% |
| COMPARATIVE EXAMPLE A3 | 5%/2% | 3%/3% |
| EXPERIMENTAL EXAMPLE A4 | 2.5%/0.4% | 3%/2% |
| COMPARATIVE EXAMPLE A4 | 4%/1.5% | 4%/2% |
| EXPERIMENTAL EXAMPLE A5 | 2%/0.4% | 2%/1% |
| COMPARATIVE EXAMPLE A5 | 4%/1.5% | 3%/4% |
| EXPERIMENTAL EXAMPLE A6 | 3%/0.4% | 3%/2% |
| COMPARATIVE EXAMPLE A6 | 4%/2% | 5%/3% |
| EXPERIMENTAL EXAMPLE A7 | 2%/0.4% | 3%/2% |
| COMPARATIVE EXAMPLE A7 | 4%/1.5% | 4%/3% |
| EXPERIMENTAL EXAMPLE A8 | 2%/0.5% | 2%/1% |
| COMPARATIVE EXAMPLE A8 | 4%/2% | 3%/3% |

(*)Average Value and Variation: Average and Variation for 1000 Samples
()High Temperature Durability Change: Left in Air at 200° C. for 1000 Hours For example, the composition analysis of EXPERIMENTAL EXAMPLE A1 and COMPARE EXAMPLE A1 by an X ray microanalyzer shows that the thermistor thin film 12 of EXPERIMENTAL EXAMPLE A1 after the heat treatment has a film composition of Mn:Co:Ni=53:19:28, whereas the thermistor thin film 12 of COMPARE EXAMPLE A1 after the heat treatment has a film composition of Mn:Co:Ni=51:20:29. Here, in both of EXPERIMENTAL EXAMPLE A1 and COMPARE EXAMPLE A1, a sintered body of Mn—Co—Ni complex oxide whose composition is Mn:Co:Ni=55:20:25 was used as the sintered body target 23; however, the composition of each of the resulting thermistor thin films 12 of EXPERIMENTAL EXAMPLE A1 and COMPARE EXAMPLE A1, shown in TABLE 2, appeared to be somewhat different from the original composition (i.e., the composition of the sintered body target 23. Further, also in the remaining examples, by properly selecting a composition for the sintered body target 23, it is possible to form a thermistor thin film 12** having a film composition as shown in the table.

Further, the X ray diffraction analysis shows that the thermistor thin films 12 after the heat treatment in EXPERIMENTAL EXAMPLES A1–A8 each have a spinel type crystal structure which is oriented mainly in a (100) surface, while on the other hand the thermistor thin films 12 of COMPARE EXAMPLES A1–A8 each have a spinel type crystal structure which is oriented at random (showing no crystal orientation property).

Further, the film surface/broken-out section observation by SEM shows that the thermistor thin films 12 after the heat treatment in EXPERIMENTAL EXAMPLES A1–A8 each have a crystal grain having a columnar structure. As TABLE 2 shows, in EXPERIMENTAL EXAMPLES A1–A8 there is shown less variation in grain diameter (the value range) in comparison with in COMPARE EXAMPLES A1–A8. In addition, none of COMPARE EXAMPLES A1–A8 have a columnar structure.

A thin film of Pt having a thickness of 0.1 $\mu$m and a resist pattern were formed all over the surface of the thermistor thin film 12 formed on the backing substrate 11 and then heat treated. This was followed by patterning by means of a photolithography technique using dry etching with Ar (argon gas) thereby to form the comb electrodes 13 and 14. Then, a dicing device was used to cut, at a size of 1×0.5 mm, the backing substrate 11 (except its periphery) to prepare 1000 individual thin film thermistor elements 10 having a structure as shown in FIG. 1 and their respective resistance values and B constants (the change rate of resistance to temperature) were measured to find average values and variations ((maximum value−minimum value)/average value). In addition, after the high temperature durability testing, in which the thin film thermistor elements 10 were left in air at 200 degrees centigrade for 1000 hours, was carried out, their resistance values and B constants were measured again to calculate change rates before and after the high temperature durability testing. TABLE 2 shows resistance value averages, B constant averages, variations, and high temperature durability changes.

As can obviously be seen from EXPERIMENTAL EXAMPLES A1–A8 and COMPARE EXAMPLES A1–A8, by forming, on the thermistor thin film 12, an oxide thin film of a spinel type crystal structure which is oriented mainly in a (100) surface, it becomes possible to produce a high-accuracy, highly-reliable thermistor element less variable in resistance value and B constant and superior in high temperature durability in comparison with the case in which an oxide thin film having a no-orientation spinel type crystal structure is formed on the thermistor thin film 12.

Any other thermistor thin films, as long as they have a spinel type crystal structure which is oriented mainly in a (100) surface, likewise produced good results even when using a complex oxide composition different from the ones shown in TABLE 2.

In addition, the formation condition and the heat treatment condition of thermistor thin films are not limited to the conditions shown in the table and can therefore be setting various ways according to the composition of sintered body targets. When the oxygen partial pressure is generally low and when the argon/oxygen flow rate is three or greater, this facilitates the formation of a spinel type crystal structure which is oriented mainly in a (100) surface.

Further, in addition to the one having the foregoing crystal structure all over the entire thermistor thin film, any other one, that partially contains a bixbite type crystal phase or an NaCl type crystal phase in a spinel type crystal phase, can be applicable. Further, even when there exists a layer on the thermistor thin film surface that is oriented to a different crystal face, what is required is that the inside of the thermistor thin film is substantially oriented in a (100) surface. More specifically, if the ratio of the peak value according to the foregoing crystal structure to the sum of peak values according to crystal structures in X ray diffraction is roughly 50% or greater (preferably 75% or greater), this will contribute to providing good characteristics (with regard to the peak value ratio, the same will, be applied to the following embodiments of the present invention).

Embodiment 2

Another example of the thin film thermistor element 10 will be described. The thin film thermistor element 10 of the second embodiment has apparently the same structure as the first embodiment (see FIG. 1) but differs from the first embodiment in that the thermistor thin film 12 is formed of, for example, complex oxide of Mn—Co—Ni having a bixbite type crystal structure. The thermistor thin film 12 of such a type can be formed by, for example, the sputter device 21 shown in FIG. 2, as in the first embodiment.

Formation Conditions and Characteristics

Hereinafter, the formation conditions of the thermistor thin film 12 (i.e., the condition of sputtering and the condition of heat treatment) will be described in a more concrete manner, together with the characteristics of the resulting thermistor thin film 12 and thin film thermistor element 10.

With regard to experimental examples B1–B8 and their corresponding compare examples B1–B8, thermistor thin films 12 were formed under conditions as shown in TABLE 3. Then, these thermistor thin films 12 thus formed were subjected to heat treatment in air under conditions as shown in the table. The major difference between EXPERIMENTAL EXAMPLE (B1–B8) and COMPARE EXAMPLE (B1–B8) is the presence or absence of rotation of the substrate holder 22. That is to say, in EXPERIMENTAL EXAMPLES B1–B8, as describe above, sputtering and oxidation/anneal are carried out alternately, while on the other hand in COMPARE EXAMPLES B1–B8 sputtering is carried out continuously without the provision of the shield cover 24. Here, alumina substrates, sized to have dimensions of 50 mm×50 mm×0.3 mm and polished to such an extent that their surface irregularity fell below 0.03 $\mu$m, were used as the backing substrate 11. The substrate holder 22 was made to hold, in addition to the backing substrate 11, a glass substrate 31 for the purpose of evaluating crystallinity.

TABLE 3

| | Target Composition | Ar/O2 Flow Rate (SCCM) | Gas Pressure (Pa) | Substrate Temperature (° C.) | Plasma Power (W) | Holder Revolution (rpm) | Film Formation Time (Minute) | Film Thickness (μ) | Heat Treatment Temperature (° C.) | Heat Treatment Time (Hour) |
|---|---|---|---|---|---|---|---|---|---|---|
| EXPERIMENTAL EXAMPLE B1 | Mn—Co—Ni | 2/1 | 1 | 400 | 800 | 5 | 180 | 1 | 700 | 10 |
| COMPARE EXAMPLE B1 | Mn—Co—Ni | 10/1 | 1 | 400 | 400 | — | 90 | 1 | 700 | 10 |
| EXPERIMENTAL EXAMPLE B2 | Mn—Co | 3/1 | 1 | 200 | 900 | 8 | 175 | 1 | 900 | 3 |
| COMPARE EXAMPLE B2 | Mn—Co | 10/1 | 1 | 200 | 400 | — | 80 | 0.95 | 900 | 3 |
| EXPERIMENTAL EXAMPLE B3 | Mn—Ni | 2/1 | 1 | 400 | 800 | 5 | 180 | 1.2 | 700 | 10 |
| COMPARE EXAMPLE B3 | Mn—Ni | 8/1 | 1 | 400 | 600 | — | 70 | 1 | 700 | 10 |
| EXPERIMENTAL EXAMPLE B4 | Mn—Co—Ni—Fe | 2/1 | 1 | 600 | 800 | 10 | 180 | 1.2 | 700 | 10 |
| COMPARE EXAMPLE B4 | Mn—Co—Ni—Fe | 5/1 | 1 | 600 | 500 | — | 80 | 1.1 | 700 | 10 |
| EXPERIMENTAL EXAMPLE B5 | Mn—Co—Ni—Al | 1/1 | 1 | 350 | 1000 | 4 | 200 | 1 | 750 | 10 |
| COMPARE EXAMPLE B5 | Mn—Co—Ni—Al | 12/1 | 1 | 350 | 400 | — | 70 | 0.9 | 750 | 10 |
| EXPERIMENTAL EXAMPLE B6 | Mn—Co—Ni—Cr | 2/1 | 1 | 500 | 900 | 10 | 160 | 1 | 600 | 30 |
| COMPARE EXAMPLE B6 | Mn—Co—Ni—Cr | 5/1 | 1 | 500 | 500 | — | 80 | 1.1 | 600 | 30 |
| EXPERIMENTAL EXAMPLE B7 | Mn—Co—Cu | 2/1 | 1 | 400 | 1200 | 8 | 160 | 1.4 | 800 | 5 |
| COMPARE EXAMPLE B7 | Mn—Co—Cu | 9/1 | 1 | 400 | 400 | — | 90 | 1 | 800 | 5 |
| EXPERIMENTAL EXAMPLE B8 | Mn—Co—Ni | 2/1 | 1 | 450 | 700 | 3 | 210 | 1.1 | 1100 | 2 |
| COMPARE EXAMPLE B8 | Mn—Co—Ni | 2/1 | 1 | 450 | 700 | 3 | 210 | 1.1 | 1300 | 2 |

The following were performed on the thermistor thin films 12 formed on the respective glass substrates 31 and then heat treated in the way as described above.

(1) Composition analysis by X ray microanalyzer; and (2) Crystal-structure observation by X ray diffraction (XRD) analysis The results are shown in TABLE 4.

TABLE 4

| | Thermistor Thin Film Composition Ratio | Crystal Structure | Orientation | Average Value(*) Resistance Value/B Constant | Variation(*) Resistance Value/B Constant |
|---|---|---|---|---|---|
| EXPERIMENTAL EXAMPLE B1 | Mn:Co:Ni = 73:19:8 | Bixbite Type | Random | 266kΩ/3320K | 3%/1% |
| COMPARATIVE EXAMPLE B1 | Mn:Co:Ni = 71:20:9 | Spinel Type | | 310kΩ/3760K | 5%/1% |
| EXPERIMENTAL EXAMPLE B2 | Mn:Co = 55:45 | Bixbite Type | (100)Orientation | 298kΩ/3290K | 2%/0.8% |
| COMPARATIVE EXAMPLE B2 | Mn:Co = 54:46 | Spinel Type | | 353kΩ/3817K | 4%/3% |
| EXPERIMENTAL EXAMPLE B3 | Mn:Ni = 65:35 | Bixbite Type | (100)Orientation | 243kΩ/3390K | 0.9%/0.4% |
| COMPARATIVE EXAMPLE B3 | Mn:Ni = 68:32 | Spinel Type | | 303kΩ/3674K | 4%/3% |
| EXPERIMENTAL EXAMPLE B4 | Mn:Co:Ni:Fe = 61:17:16:6 | Bixbite Type | (111)Orientation | 277kΩ/3275K | 2%/1% |
| COMPARATIVE EXAMPLE B4 | Mn:Co:Ni:Fe = 59:22:16:6 | Spinel Type | | 269kΩ/3520K | 6%/3% |
| EXPERIMENTAL EXAMPLE B5 | Mn:Co:Ni:Al = 72:15:8:5 | Bixbite Type | (100)Orientation | 206kΩ/3370K | 2.5%/1% |
| COMPARATIVE EXAMPLE B5 | Mn:Co:Ni:Al = 71:14:9:6 | Spinel Type | | 311kΩ/3684K | 5%/2% |
| EXPERIMENTAL EXAMPLE B6 | Mn:Co:Ni:Cr = 70:20:7:3 | Bixbite Type | (111)Orientation | 210kΩ/3193K | 2.5%/1 |
| COMPARATIVE EXAMPLE B6 | Mn:Co:Ni:Cr = 70:20:6:4 | Spinel Type | | 307kΩ/3605K | 5%/2% |
| EXPERIMENTAL EXAMPLE B7 | Mn:Co:Cu = 75:20:5 | Bixbite Type | Random | 17kΩ/2890K | 3%/1% |

TABLE 4-continued

| | | | | | |
|---|---|---|---|---|---|
| COMPARATIVE EXAMPLE B7 | Mn:Co:Cu = 74:21:5 | Spinel Type | | 20kΩ/3075K | 4%/2% |
| EXPERIMENTAL EXAMPLE B8 | Mn—Co—Ni =76:15:9 | Bixbite Type | (111)Orientation | 298kΩ/3415K | 2%/0.8% |
| COMPARATIVE EXAMPLE B8 | Mn—Co—Ni = 76:15:9 | Spinel Type | | 324kΩ/3855K | 6%/3% |

| | Deterioration with Time(**) Resistance Value/B Constant | High Temperature Durability Change(***) Resistance Value/B Constant |
|---|---|---|
| EXPERIMENTAL EXAMPLE B1 | 0.8%/0.4% | 1%/1% |
| COMPARATIVE EXAMPLE B1 | 4%/3% | 3%/2% |
| EXPERIMENTAL EXAMPLE B2 | 0.9%/0.6% | 0.9%/1% |
| COMPARATIVE EXAMPLE B2 | 5%/3% | 5%/2% |
| EXPERIMENTAL EXAMPLE B3 | 1%/0.5% | 1%/1% |
| COMPARATIVE EXAMPLE B3 | 4%/2.5% | 3%/3% |
| EXPERIMENTAL EXAMPLE B4 | 0.8%/0.5% | 0.8%/0.6% |
| COMPARATIVE EXAMPLE B4 | 5%/3% | 4%/2% |
| EXPERIMENTAL EXAMPLE B5 | 0.9%/0.6% | 1%/1% |
| COMPARATIVE EXAMPLE B5 | 3%/3% | 3%/4% |
| EXPERIMENTAL EXAMPLE B6 | 0.7%/0.4% | 0.9%/0.8% |
| COMPARATIVE EXAMPLE B6 | 4%/3% | 5%/3% |
| EXPERIMENTAL EXAMPLE B7 | 0.9%/0.4% | 1%/1% |
| COMPARATIVE EXAMPLE B7 | 5%/3% | 4%/3% |
| EXPERIMENTAL EXAMPLE B8 | 0.8%/0.4% | 1%/1% |
| COMPARATIVE EXAMPLE B8 | 7%/3% | 4%/3% |

(*)Average Value and Variation: Average and Variation for 1000 Samples
(**)Deterioration with Time: Left at Room Temperature for 1000 Days
(*)High Temperature Durability Change: Left in Air at 300° C. for 1000 Hours For example, the composition analysis of EXPERIMENTAL EXAMPLE B1 and COMPARE EXAMPLE B1 by an X ray microanalyzer shows that the thermistor thin film 12 of EXPERIMENTAL EXAMPLE B1 after the heat treatment has a film composition of Mn:Co:Ni=73:19:8, whereas the thermistor thin film 12 of COMPARE EXAMPLE B1 after the heat treatment has a film composition of Mn:Co:Ni=71:20:9. Here, in both of EXPERIMENTAL EXAMPLE B1 and COMPARE EXAMPLE B1, a sintered body of Mn—Co—Ni complex oxide whose composition is Mn:Co:Ni=75:20:5 was used as the sintered body target 23; however, the resulting thermistor thin films 12 each had a composition somewhat different from that of the aforesaid sintered body target 23. Further, also in the remaining examples, by properly selecting a composition for the sintered body target 23, it is possible to form a thermistor thin film 12** having a film composition as shown in the table.

Further, the X ray diffraction analysis shows that the thermistor thin films 12 after the heat treatment in EXPERIMENTAL EXAMPLES B1–B8 each have a bixbite type crystal structure, while on the other hand the thermistor thin films 12 of COMPARE EXAMPLES B1–B8 each have a spinel type crystal structure. Moreover, among EXPERIMENTAL EXAMPLES B1–B8, (i) EXPERIMENTAL EXAMPLES B2, B3, and Beach have a priority orientation in a (100) surface, (ii) EXPERIMENTAL EXAMPLES B4, B6, and B8 each have a priority orientation in a (111) surface, and (iii) neither EXPERIMENTAL EXAMPLE B1 nor EXPERIMENTAL EXAMPLE B7 shows any priority orientation, in other words, they are random in orientation.

A thin film of Pt having a thickness of 0.1 μm and a resist pattern were formed all over the surface of the thermistor thin film 12 formed on the backing substrate 11 and then heat treated. This was followed by patterning by means of a photolithography technique using dry etching with Ar (argon gas) thereby to form the comb electrodes 13 and 14. Then, a dicing device was used to cut, at a size of 1×0.5 mm, the backing substrate 11 (except its periphery) to prepare 1000 individual thin film thermistor elements 10 having a structure as shown in FIG. 1 and their respective resistance values and B constants (the change rate of resistance to temperature) were measured to find average values and variations ((maximum value−minimum value)/average value). In addition, after the deterioration-with-time testing in which the thin film thermistor elements were left at room temperature for 100 days and the high temperature durability testing in which the thin film thermistor elements 10 were left in air at 300 degrees centigrade for 1000 hours were carried out, their resistance values and B constants were measured again to calculate change rates before and after the deterioration-with-time testing and the high temperature durability testing. TABLE 4 shows resistance value averages, B constant averages, variations, deterioration-with-time changes, and high temperature durability changes.

As can obviously be seen from EXPERIMENTAL EXAMPLES B1–B8 and COMPARE EXAMPLES B1–B8, by forming, on the thermistor thin film 12, an oxide thin film having a bixbite type crystal structure, it becomes possible to produce a high-accuracy, highly-reliable thermistor element less variable in resistance value and B constant, less subject to deterioration with time, and superior in high temperature durability in comparison with the case in which an oxide thin film having a spinel type crystal structure is formed on the thermistor thin film 12.

Any other thermistor thin films, as long as they have a bixbite type crystal structure, likewise produced good results even when using a complex oxide composition different from the ones shown in TABLE 4.

In addition, the formation condition and the heat treatment condition of thermistor thin films are not limited to the conditions shown in the table and can therefore be set in various ways according to the composition of sintered body targets. When the oxygen partial pressure is generally high or when there is much Mn in composition (for example, when the Mn composition contained is 55% or more by molar ratio), it is likely that the foregoing bixbite type crystal structure is formed. Further, in the case of forming a bixbite type crystal structure, (i) if the oxygen partial pressure is generally high and the substrate temperature is low, it is likely that a priority orientation in a (100) surface is exhibited and, on the other hand, (ii) if the oxygen partial pressure is low and the substrate temperature is high, it is likely that a priority orientation in a (111) surface is exhibited. Moreover, when the heat treatment temperature exceeds, for example, 1100 degrees centigrade, it is likely that a spinel type crystal structure is formed.

Further, in addition to the one having the foregoing crystal structure all over the entire thermistor thin film, any other one, that partially contains a spinel type crystal phase or an NaCl type crystal phase in a bixbite type crystal phase, can be applicable.

Embodiment 3

Still another example of the thin film thermistor element 10 will be described. The thin film thermistor element 10 of the third embodiment has apparently the same structure as the first embodiment (see FIG. 1) but differs from the first embodiment in that the thermistor thin film 12 is formed of, for example, $LaCoO_3$ having a rhombohedral perovskite type crystal structure. The thermistor thin film 12 of such a type can be formed by, for example, the sputter device 21 shown in FIG. 2, as in the first embodiment.

Formation Conditions and Characteristics

Hereinafter, the formation conditions of the thermistor thin film 12 (i.e., the condition of sputtering and the condition of heat treatment) will be described in a more concrete manner, together with the characteristics of the resulting thermistor thin film 12 and thin film thermistor element 10.

With regard to experimental examples C1–C8, thermistor thin films 12 were formed under conditions as shown in TABLE 5. Then, these thermistor thin films 12 thus formed were subjected to heat treatment in air under conditions as shown in the table. Here, alumina substrates, sized to have dimensions of 120 mm×60 mm×0.3 mm and polished to such an extent that their surface irregularity fell below 0.03 μm, were used as the backing substrate 11. The substrate holder 22 was made to hold, in addition to the backing substrate 11, a glass substrate 31 for the purpose of evaluating crystallinity.

TABLE 5

| | Target Composition | Ar/O2 Flow Rate (SCCM) | Gas Pressure (Pa) | Substrate Temperature (° C.) | Plasma Power (W) | Holder Revolution (rpm) | Film Formation Time (Minute) | Film Thickness (nm) | Heat Treatment Temperature (° C.) | Heat Treatment Time (Hour) |
|---|---|---|---|---|---|---|---|---|---|---|
| EXPERIMENTAL EXAMPLE C1 | La:Co = 48.4:51.6 | 14/6 | 1 | 500 | 600 | 5 | 100 | 2.1 | 800 | 5 |
| EXPERIMENTAL EXAMPLE C2 | " | 10/10 | 1.2 | 450 | 800 | 2 | 80 | 2.0 | 750 | 6 |
| EXPERIMENTAL EXAMPLE C3 | " | 17/3 | 0.8 | 600 | 400 | 10 | 120 | 1.8 | 600 | 10 |
| COMPARATIVE EXAMPLE C | (La:Co = 48.4:51.6, Formation of a sintered body with a rhombohedral perovskite type crystal structure) | | | | | | | | | |

The following were performed on the thermistor thin films 12 formed on the respective glass substrates 31 and then subjected to heat treatment in the way as described above.

(1) Composition analysis by X ray microanalyzer; and (2) Crystal-structure observation by X ray diffraction (XRD) analysis The results are shown in TABLE 6.

TABLE 6

| | Thermistor (Thin Film or Sintered Body) Composition | Crystal Structure | Orientation | Resistance Value Average Value/Variation | B Constant (Bo) Average Value/Variation | B Constant (B150) Average Value/Variation |
|---|---|---|---|---|---|---|
| EXPERIMENTAL EXAMPLE C1 | La:Co = 48.9:51.1 | Rhombohedral Perovskite Type | (012)Orientation | 8.61kΩ/1.7% | 3256k/0.9% | 4320k/0.8% |
| EXPERIMENTAL EXAMPLE C2 | La:Co = 48.5:51.5 | Rhombohedral Perovskite Type | (012)Orientation | 8.90kΩ/0.9% | 3287k/0.7% | 4390k/0.7% |

TABLE 6-continued

| | Thermistor (Thin Film or Sintered Body) Composition | Crystal Structure | Orientation | Resistance Value Average Value/Variation | B Constant (Bo) Average Value/Variation | B Constant (B150) Average Value/Variation |
|---|---|---|---|---|---|---|
| EXPERIMENTAL EXAMPLE C3 | La:Co = 49.0:51.0 | Rhombohedral Perovskite Type | Random | 9.24kΩ/1.8% | 3250/1% | 4318k/1% |
| COMPARATIVE EXAMPLE C (Sintered Body) | La:Co = 48.4:51.6 | Rhombohedral Perovskite Type | | 9.00kΩ/4.0% | 3270/3.0% | 4340k/2.5% |

For example, the composition analysis of EXPERIMENTAL EXAMPLE C1 by an X ray microanalyzer shows that the thermistor thin film 12 of EXPERIMENTAL EXAMPLE C1 has a film composition of La:Co=48.9:51.1. Here, in the case of EXPERIMENTAL EXAMPLE C1, a sintered body of La—Co complex oxide whose composition is La:Co=48.4:51.6 was used as the sintered body target 23; however, the resulting thermistor thin film 12 had a composition somewhat different from that of the aforesaid sintered body target 23. Further, also in the remaining examples, by properly selecting a composition for the sintered body target 23, it is possible to form a thermistor thin film 12 having a film composition as shown in the table.

Further, the X ray diffraction analysis shows that the thermistor thin films 12 after the heat treatment in EXPERIMENTAL EXAMPLES C1 and C2 each have a rhombohedral perovskite type crystal structure. Further, EXPERIMENTAL EXAMPLES C1 and C2 each have a priority orientation in a (012) surface, whereas EXPERIMENTAL EXAMPLE C3 has no priority orientation, in other words, it is random in orientation.

A thin film of Pt having a thickness of 0.1 $\mu$m and a resist pattern were formed all over the surface of the thermistor thin film 12 formed on the backing substrate 11 and then subjected to heat treatment. This was followed by patterning by means of a photolithography technique using dry etching with Ar (argon gas) thereby to form the comb electrodes 13 and 14. Then, a dicing device was used to cut, at a size of 3.2×1.6 mm, the backing substrate 11 (except its periphery) to prepare 1000 individual thin film thermistor elements 10 having a structure as shown in FIG. 1 and their respective resistance values and B constants (the change rate of resistance to temperature, BO: the change rates at 0–25 degrees centigrade; B150: the change rates at 25–150 degrees centigrade ) were measured to find average values and variations ((maximum value−minimum value)/average value). The results thereof are shown in TABLE 6.

For comparison, a sintered body having a rhombohedral perovskite type crystal structure was formed (baking condition: 1500 degrees centigrade; baking time: 4 hours), having the same target composition as EXPERIMENTAL EXAMPLES C1–C3 (i.e., La:Co=48.4:51.6). After the formation of thin film electrodes of silver by a sputtering technique, the sintered body was cut at a size of 3.2×1.6 mm to prepare 1000 sintered body thermistor elements and their respective resistance values and B constants (the change rate of resistance to temperature, BO: the change rates at 0–25 degrees centigrade; B150: the change rates at 25–150 degrees centigrade ) were measured to find average values and variations ((maximum value−minimum value)/average value). The results thereof are shown in COMPARE EXAMPLE C of TABLE 6.

As can obviously be seen from EXPERIMENTAL EXAMPLES C1–C3 and COMPARE EXAMPLE C, in comparison with conventional sintered body elements the thin film thermistor elements of these examples are much less variable in resistance value and B constant and have achieved high accuracy.

$LaCoO_3$ having a rhombohedral perovskite type crystal structure is used as rare earth transition metal oxide for forming the thermistor thin film 12, which is however not considered to be restrictive. For instance, instead of La, other rare earth elements including Ce, Pr, Nd, Sm, Gd, and Tb are applicable, and instead of Co, other transition metal elements including Ti, V, Cr, Mn, Fe, and Ni are applicable. In both the cases, the same good results were obtained. Furthermore, even when rare earth transition metal oxide contains, as an additive thereto, Al oxide or Si oxide, the same good results were obtained.

Embodiment 4

Fine adjustment of the resistance value of the thin film thermistor elements 10 of the first to third embodiments (EXPERIMENTAL EXAMPLES A1–A8, B1–B8, and C1–C3) will be described. Such resistance value fine adjustment is not always required, which however makes it possible to form the thin film thermistor element 10 at higher accuracy.

First, the mechanism of resistance-value fine adjustment is described. As described previously, the comb electrode (13, 14) is provided with the base resistance portion (13*a*, 14*a*) and the trimming portion (13*b*, 14*b* ), wherein a base resistor is formed of a portion defined between the base resistance portions 13*a* and 14*a* in the thermistor thin film 12 while on the other hand a resistor for fine adjustment is formed of a portion defined between the trimming portion 13*b* and each trimming portion 14*b*. The base resistor and each fine adjustment resistor are connected together in parallel. Moreover, each fine adjustment resistor differs in resistance value from the other fine adjustment resistors and the resistance value of each of the fine adjustment resistors is set greater than that of the base resistor. Furthermore, the resistance value of the base resistor is set somewhat greater than the target resistance value of the thin film thermistor element 10 and, in addition, it is set such that the base resistor fine adjustment resistor composite resistance value is lower than the target resistance value by about 10%. Then, the trimming portion 14*b* is selectively cut, so that the resistance value of the thin film thermistor element 10 can be fine adjusted. In order to accurately perform fine adjustment by the cutting of the trimming portion 14*b*, an arrangement may be made beforehand in which thermistor thin film patterning is carried out such that the thermistor thin film 12 exists only between each trimming portion 14*b* and the trimming portion 13*b*. Such patterning can be implemented by means of masking during formation of the thermistor thin film 12 or by photolithography after the thermistor thin film 12 is formed.

Next, a concrete example of the fine adjustment will be described. In each of the first to third embodiments of the present invention, after a Pt thin film is patterned to form the comb electrodes 13 and 14, the resistance value of each thin film thermistor element 10 is measured. According to the resistance value measured, the trimming portion 14*b* is irradiated with, for example, YAG laser light for selective cutting of the trimming portion 14*b*. This is followed by cutting the backing substrate 11 at a size of 1×0.5 mm (in the first and second embodiments) and at a size of 3.2×1.6 mm (in the third embodiment), for separation into 1000 individual thin film thermistor elements 10. Thereafter, the resistance value of each thin film thermistor element 10 was measured again to find average values and variations ((maximum value−minimum value average value). The results are shown in TABLE 7. As TABLE 7 clearly shows, it is possible to obtain much higher-accuracy thermistor elements by performing fine adjustment of the resistance value by trimming a portion of the comb electrode (13, 14) which is a Pt electrode formed on the thermistor thin film 12.

TABLE 7

| | Resistance Value before Trimming Average Value/ Variation | Resistance Value after Trimming Target Value/ Average Value/ Variation |
|---|---|---|
| EXPERIMENTAL EXAMPLE A1 | 270 kΩ/2% | 300 kΩ/300 kΩ/0.5% |
| EXPERIMENTAL EXAMPLE A2 | 318 kΩ/2% | 340 kΩ/340 kΩ/0.7% |
| EXPERIMENTAL EXAMPLE A3 | 243 kΩ/3% | 260 kΩ/260 kΩ/0.5% |
| EXPERIMENTAL EXAMPLE A4 | 267 kΩ/2.5% | 290 kΩ/290 kΩ/0.6% |
| EXPERIMENTAL EXAMPLE A5 | 32 kΩ/2% | 35 kΩ/35 kΩ/0.7% |
| EXPERIMENTAL EXAMPLE A6 | 210 kΩ/3% | 230 kΩ/230 kΩ/0.8% |
| EXPERIMENTAL EXAMPLE A7 | 251 kΩ/2% | 270 kΩ/270 kΩ/0.5% |
| EXPERIMENTAL EXAMPLE A8 | 310 kΩ/2% | 340 kΩ/340 kΩ/0.6% |
| EXPERIMENTAL EXAMPLE B1 | 266 kΩ/3% | 280 kΩ/280 kΩ/0.4% |
| EXPERIMENTAL EXAMPLE B2 | 298 kΩ/2% | 330 kΩ/330 kΩ/0.5% |
| EXPERIMENTAL EXAMPLE B3 | 243 kΩ/0.9% | 260 kΩ/260 kΩ/0.4% |
| EXPERIMENTAL EXAMPLE B4 | 277 kΩ/2% | 300 kΩ/300 kΩ/0.6% |
| EXPERIMENTAL EXAMPLE B5 | 260 kΩ/2.5% | 290 kΩ/290 kΩ/0.8% |
| EXPERIMENTAL EXAMPLE B6 | 210 kΩ/2.5% | 230 kΩ/230 kΩ/0.7% |
| EXPERIMENTAL EXAMPLE B7 | 17 kΩ/3% | 19 kΩ/19 kΩ/0.8% |
| EXPERIMENTAL EXAMPLE B8 | 298 kΩ/2% | 320 kΩ/320 kΩ/0.7% |
| EXPERIMENTAL EXAMPLE C1 | 8.6 kΩ/1.7% | 9.2 kΩ/9.2 kΩ/0.4% |
| EXPERIMENTAL EXAMPLE C2 | 8.90 kΩ/0.9% | 9.5 kΩ/9.5 kΩ/0.5% |
| EXPERIMENTAL EXAMPLE C3 | 9.24 kΩ/1.8% | 10.0 kΩ/10.0 kΩ/0.6% |

The foregoing resistance-value fine adjustment may be made after separation into the individual thin film thermistor elements 10 (i.e., after the cutting of the backing substrate 11). However, in general it is convenient to perform resistance-value fine adjustment before such separation, in terms of handling easiness for resistance-value measurement and for the cutting of the trimming portion 14*b*.

In each of the embodiments of the present invention, an alumina substrate is used as the backing substrate 11. However, the same good results were obtainable, even for the case of using a ceramics substrate or glass substrate as the backing substrate 11.

Additionally, Pt is used as electrode material. However, the same good result were obtained, ever for the case of using palladium, iridium, ruthenium, gold, silver, nickel, copper, chromium, or their alloy as electrode material.

Figure 3:
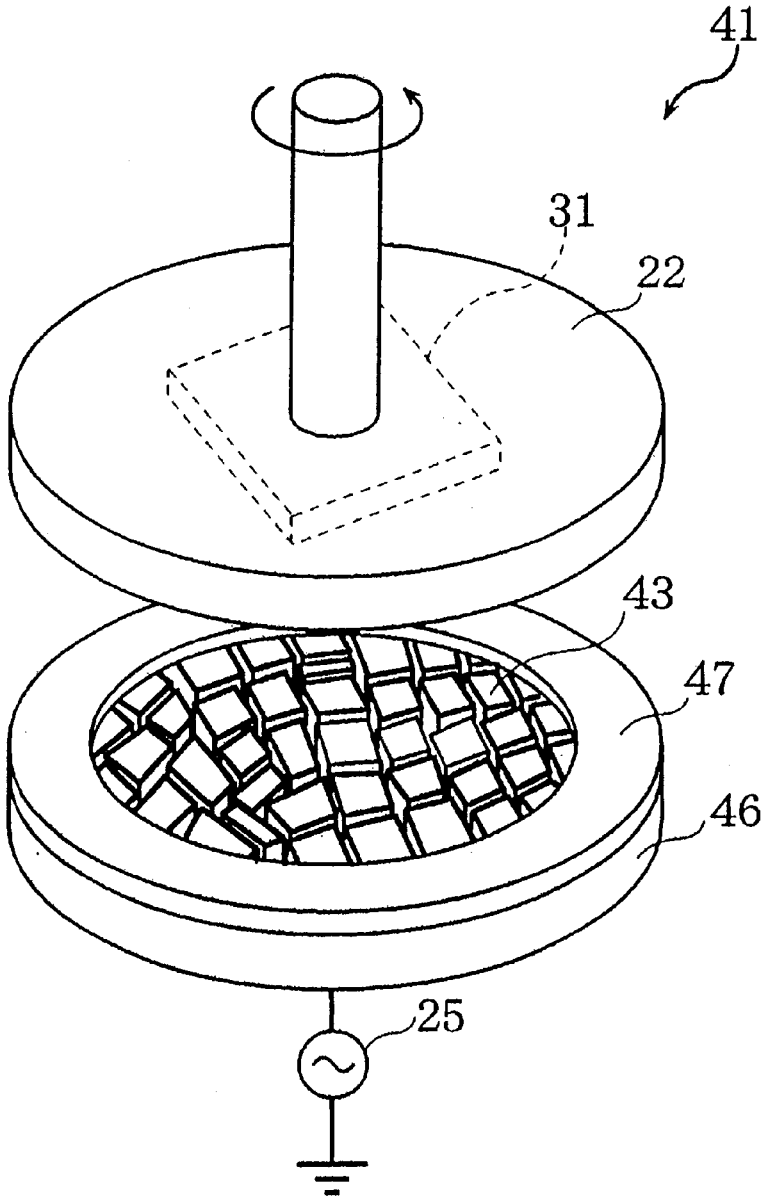
FIG. 3 is a perspective view illustrating a structure of another device used to fabricate a thin film thermistor element according to the present invention.

Further, the sintered body target 23 used in forming the thermistor thin film 12 by sputtering is not necessarily the above-described, integrally-formed one. In other words, in order to form the thermistor thin film 12 which is uniform, it is required that the sintered body target 23 is larger than the film formation area of the thermistor thin film 12 and, in addition, in order to fabricate a large quantity of the thin film thermistor elements 10 at a time, it is preferable to use a target as large as possible (for example, diameter: 10 inches; thickness: 5 mm). However, since the material of the sintered body target 23 is hard and fragile, it is considerably difficult to perform bonding to the backing plate after sintering in uniform and close manner to a large area. To cope with such difficulty, an arrangement, as shown in FIG. 3, may be made in which, for example, $LaCoO_3$-oxide sintered body blocks 43 of three kinds of sizes, i.e., 40×40 mm (×5 mm: thickness), 40×20 mm (×5 mm: thickness) and or 20×20 mm (×5 mm: thickness), are spread all over a Cu backing plate 46 having a diameter of 250 mm at intervals of 0.5 mm and bonding is carried out, and its peripheral portion is covered with an earth shield 47 whose opening portion diameter is 200 mm (in FIG. 3, the shield cover 24 shown in FIG. 2 is omitted). In this way, by virtue of the use of the sintered body blocks 43, it becomes possible to easily obtain the thermistor thin film 12 which has a large area and is high in uniformity.

Further, a high frequency power supply is used to sputter the thermistor thin film 12, which is however not considered to be restrictive. For example, sputtering may be carried out by creation of a plasma by ECR (electron cyclotron resonance).

Furthermore, the way of forming the thermistor thin film 12 (particularly, for example, one having a bixbite type crystal structure which is oriented mainly in a (100) or (111) surface) is not limited to the foregoing intermittent sputtering. For instance, such a thermistor thin film may be formed by continuous sputtering after properly setting film formation conditions. Also in such a case, it is possible to easily improve the uniformity of thermistor thin films by rotating the substrate holder 22 or the sintered body target 23.

What is claimed is:

1. A thin film thermistor element comprising a thermistor thin film and a pair of electrodes formed on said thermistor thin film, wherein said thermistor thin film is formed by sputtering, and has a spinel type crystal structure which is oriented in a (100) surface.

2. The thin film thermistor element as defined in claim 1, wherein said thermistor thin film has a crystal grain grown by crystallization into a columnar shape in a direction perpendicular with respect to said thermistor thin film.

3. The thin film thermistor element as defined in either claim 1, wherein said thermistor thin film is an oxide thin film whose major component is manganese.

4. The thin film thermistor element as defined in claim 1, wherein said thermistor thin film is a thermistor thin film which is formed by alternately performing a film formation process by sputtering and an anneal process.

5. The thin film thermistor element as defined in claim 4, wherein said thermistor thin film is subjected to a heat treatment after said film formation process by sputtering.

6. The thin film thermistor element as defined in claim 1, wherein either one of said pair of electrodes has a trimming portion for adjustment of the value of resistance.

7. A thin film thermistor element comprising a thermistor thin film and a pair of electrodes formed on said thermistor thin film wherein said thermistor thin film is formed by sputtering, and has a bixbite type crystal structure that is oriented in one of a (100) surface or a (111) surface.

8. A thin film thermistor element comprising a thermistor thin film and a pair of electrodes formed on said thermistor thin film, wherein said thermistor thin film is formed by sputtering, and has a rhombohedral perovskite type crystal structure that is oriented in a (012) surface.

9. The thin film thermistor element as defined in claim 8, wherein said thermistor thin film contains lanthanum cobalt oxide.

* * * * *

UNITED STATES PATENT AND TRADEMARK OFFICE

CERTIFICATE OF CORRECTION

PATENT NO. : 6,475,604 B1
DATED : November 5, 2002
INVENTOR(S) : Fujii et al.

It is certified that error appears in the above-identified patent and that said Letters Patent is hereby corrected as shown below:

Title page,
Item [56], References Cited, FOREIGN PATENT DOCUMENTS, insert
-- JP63-266801A --.

Signed and Sealed this

Eighteenth Day of March, 2003

JAMES E. ROGAN
*Director of the United States Patent and Trademark Office*